US005509628A

United States Patent [19]

Noble

[11] Patent Number: 5,509,628

[45] Date of Patent: Apr. 23, 1996

[54] ERGONOMIC SUPPORT FOR KEYBOARD AND COMPUTER MOUSE PLATFORM

[76] Inventor: Bruce Noble, 201 Park Ave., Emerson, N.J. 07630

[21] Appl. No.: 489,302

[22] Filed: Jun. 9, 1995

[51] Int. Cl.[6] ..... B68G 5/00

[52] U.S. Cl. ..... 248/118; 248/918

[58] Field of Search ..... 248/118, 118.1, 248/118.3, 118.5, 918; 400/715

[56] References Cited

U.S. PATENT DOCUMENTS

| | | | |
|---|---|---|---|
| 134,116 | 12/1872 | West . | |
| D. 306,239 | 2/1990 | Watt . | |
| 3,123,935 | 3/1964 | Williams . | |
| 4,129,746 | 12/1978 | Lambden . | |
| 4,616,798 | 10/1986 | Smeenge et al. . | |
| 4,913,390 | 4/1990 | Berke . | |
| 5,037,054 | 8/1991 | McConnell . | |
| 5,040,757 | 8/1991 | Benaway | 248/118.3 |
| 5,131,614 | 7/1992 | Garcia et al. . | |
| 5,145,270 | 9/1992 | Darden | 248/118.3 X |
| 5,147,090 | 9/1992 | Mandell et al. . | |
| 5,188,321 | 2/1993 | Hirschenson et al. . | |
| 5,219,136 | 6/1993 | Hassel et al. . | |
| 5,228,655 | 7/1993 | Garcia et al. . | |
| 5,234,186 | 8/1993 | Powell | 248/918 X |
| 5,242,139 | 9/1993 | Aldrich | 248/918 X |
| 5,244,296 | 9/1993 | Jensen . | |
| 5,257,767 | 11/1993 | McConnell . | |
| 5,273,250 | 12/1993 | Pemberton et al. . | |
| 5,288,042 | 2/1994 | Grimm | 248/118 |
| 5,340,067 | 8/1994 | Martin et al. . | |
| 5,346,164 | 9/1994 | Allen . | |
| 5,351,897 | 10/1994 | Martin . | |
| 5,374,018 | 12/1994 | Daneshvar | 248/118 |
| 5,375,800 | 12/1994 | Wilcox | 248/918 X |

OTHER PUBLICATIONS

Global Computer Supplies (Dec. 1994) pp. 80, 82 and 83.

Paoli Furniture, Paoli, Ind.—1 pg.

Ergonomic Environments, Inc. (Aurora) 2 pgs—Park City, Utah.

PC Compatibles (New Product Section) pp. 11 and 12.

Details, 379 Broadway, NY, N.Y. 10012 (1983) 1 pg.

*Primary Examiner*—J. Franklin Foss

*Attorney, Agent, or Firm*—Lackenbach, Siegel, Marzullo, Aronson & Greenspan

[57] ABSTRACT

An ergonomic keyboard support device for a computer keyboard having a substantially planar key upper plane, comprising a keyboard support having an operator-proximal keyboard support edge and a substantially planar keyboard support top surface; a support bar for maintaining wrist and forearm support during keyboard operations; and a computer mouse platform for holding a computer mouse and for writing by a keyboard operator and for maintaining wrist support during mouse operations. The support bar, which is connected to the top surface of the keyboard support across the operator-proximal keyboard support edge, has a substantially planar bar top surface. The mouse platform is movably positioned upon the planar top surface of the keyboard support and has a substantially planar top surface that is substantially in the same plane as the planar bar top surface. A wedge under the support platform upon a carriage plate connected to articulated linkage tilts the keyboard support at approximately 8° relative to the horizontal so that in turn the keyboard frame is tilted to an angle wherein the upper plane defined by the keyboard keys is horizontal along with the top planes of the support bar and the mouse platform. The articulated linkage can tilt the device to a plurality of angles and positions.

15 Claims, 7 Drawing Sheets

ERGONOMIC SUPPORT FOR KEYBOARD AND COMPUTER MOUSE PLATFORM

FIELD OF THE INVENTION

This invention relates generally to the field of supports for keyboards for personal computers.

BACKGROUND OF THE INVENTION

The use of desktop computers has grown dramatically since the introduction of the personal computer in 1981. An estimated 75% of all workers are sedentary, and many of those use personal computers as a part of their jobs. In addition, schools, colleges, libraries and other institutions have invested heavily in electronics to keep their communities current with the latest technologies and information sources.

Unfortunately, many of these computers are situated on furniture that was not designed either to support the computer hardware or to promote a healthy interface between the machines and the operators.

The standard height of worksurfaces on desks is 29 to 30 inches. The most common configuration of a desk for office work is a unit at that height, having two 15 inch inch wide pedestals for 11 inch paper filing, and a 28 inch wide knee space that includes a center drawer for storing small office supplies. The typical stand-alone desktop computer requires space for a monitor, a central processing unit, keyboard, a computer mouse or trackball, a printer and a side assortment of add-on peripherals and accessories. All of this hardware robs the individual worker of space so important for effectively and comfortably performing normal workplace tasks. More important, the input devices—the keyboard and computer mouse being the most popular—are too frequently placed on top of the 29–30 inch high work surface. This placement forces an operator's arms, hands, shoulders, and back into postures that are unnatural and frequently uncomfortable. If these postures are repeated over several hours each day for a period of months or years, an operator may experience symptoms ranging from mild discomfort through chronic pain to disabling injury.

The human and economic costs of unhealthy postures and repetitive strain injuries have been widely documented in corporate, scientific, and governmental literature. The Federal government, acting through the Occupational Safety and Health Administration is preparing Ergonomic Protection Standard that would apply to computer use in the workplace. It would set performance-oriented guidelines. At the earliest date, they would go into effect in 1996. Absent a Federal guideline, many organizations have begun concerted efforts to make their office environments more ergonomically sound.

Office furniture and office product manufacturers have offered a wide variety of products that are marketed as ergonomic. Many of these items fail to meet any of the criteria for ergonomic soundness, and some even worsen the situation by encouraging operators to assume unhealthy postures. Some contract furniture manufacturers offer adjustable-height tables and desks, and adjustable keyboard and computer mouse supports. Unfortunately, the price of most of these items puts them out of reach for millions of workers. All too often, the primary factor determining whether or not to buy a computer accessory or computer furniture is the purchase price. A buyer's perception of achieving greater comfort, as suggested by the marketing efforts of the manufacturer or distributor, often leads to the purchase of items that turn out to have little or no positive effect.

One basic requirement for supporting healthy body postures for operators using a keyboard and a computer mouse is that the keyboard support that holds these devices includes swiveling, tilting, and height adjustment mechanisms. A height adjustment places the keyboard support between 22 inches and 27 inches above floor level in order to promote an upper extremities neutral posture for 95% of the U.S. population. The negative side of the keyboard support tilt compensates for the positive tilt built into keyboards. A negative tilt of 23° allows most standing operators to input with wrist neutrality when the computer is placed on desk height (29–30 inch) furniture. Tilting mechanisms also provide an option of a small positive tilt to allow operators who prefer that inclination to continue keying in a manner that is both comfortable and efficient for their keying habits. It also allows users of notebook computers to position their bodies comfortably while maintaining wrist neutrality. Swiveling mechanisms allow operators to position their bodies, keyboards, and computer mouses in alignment with monitors that are located in a corner of the work station.

Since computers are often used by various people throughout the day, it is essential that the platform support a rapid, easy transition for left- or right-hand mouse (or trackball) users. Also, there should be an area large enough to support a person's hand and forearm. This area is used for resting between mouse operations to preclude resting one's arm weight on the mouse and prevent the resultant static clenching posture of one's hand gripping the mouse.

Some prior art combinations of a support for a keyboard and a computer mouse and a storage area for small office supplies are discussed below.

The Snapease line by Rubbermaid allows the computer mouse to be placed to the left or the right of the keyboard, and space is provided for supplies. The keyboard supports are either 42–46 inches wide and are designed for use only with a Rubbermaid desk. The keyboard and computer mouse support does not tilt or adjust for height with the negative result that it does not promote healthy neutral postures for operators of various sizes.

The Aurora keyboard support system by Ergonomic Environments offers a model that provides keyboard and computer mouse support within a 27.5 inch overall width. The unit is tilt and height adjustable. But it provides no storage for supplies. Moreover, it does not promote healthy mousing postures, because the computer mouse support is not deep enough to act as a forearm rest between mousing episodes.

The Flex Rest manufactures a keyboard drawer that is tilt and height adjustable which includes a pivoting computer mouse tray and pencil tray. The unit tilts only negatively, thereby failing to accommodate the needs of users who prefer a positive slope. The computer mouse tray is too shallow for forearm support. The storage area is minimal. The unit is too wide to fit in the 28 inch knee space of a conventional 60 inch by 30 inch desk.

Rubbermaid also manufacturers computer mouse platforms, that attach to several of its under-desk keyboard drawers, as disclosed in U.S. Pat. No. 330,892. The drawers have small hinged compartments for pencils, clips, and so on. The drawers are not height and tilt adjustable, and the computer mouse platform is very shallow.

Global Computer Supplies offers two related items. The first is a keyboard support that starts at desk height which can be lowered in three increments to 3.75 inches below the work surface. It has a small storage area for supplies and an optional computer mouse tray that attaches left or right. The unit has no tilt adjustment, and the 3.75 inch computer mouse adjustment below the top of the work surface is not sufficient to promote wrist neutrality for 95% of seated operators. The second item tilts plus/minus 15° and adjusts from 2.75 inches to 5 inches below the worksurface. The 2.25 inch height adjustment range does not allow neutral postures for many operators. Also, because the unit is mounted on ball bearing slides rather than to an articulating arm, it is cumbersome to adjust the height once the unit is installed.

Manufacturers such as Details, Knoll, Haworth, Herman Miller, Proformix, and Ergo Systems offer several keyboard supports. Both Details and Proformix have additional computer mouse supports that can swivel and tilt. But none provide supply storage that allows the operator to discard the desk center drawer and retain adequate under-desk storage volume.

Prior art also reveals attempts to solve one or more ergonomic issues associated with wrist supports for keyboard operators. Some such patents are as follows:

U.S. Pat. No. 5,273,250 discloses a forearm resting member that is substantially coplanar with the top surface of the keyboard apparatus.

U.S. Pat. No. 5,244,296 discloses an edge portion elevated to a level substantially above the immediately adjacent keys to maintain proper wrist angle during keyboard use. The elevated region of the edge portion is parallel to the planar surface of the keyboard housing.

U.S. Pat. No. 5,228,655 discloses a wrist rest on which both wrists are supported that is higher than the top of the keyboard. One purpose of the wrist support is to maintain an angle between the wrist and the hand while typing that minimizes strain on the wrist thereby preventing repetitive motion strain syndrome.

U.S. Pat. No. 5,131,614

U.S. Pat. No. 5,147,090

U.S. Pat. No. 5,188,321

U.S. Pat. No. 5,219,136

U.S. Pat. No. 5,244,296

Prior art patents also reveal apparatuses for adjusting supports for computer keyboards. Some such patents are as follows:

U.S. Pat. No. 4,616,798

U.S. Pat. No. 4,913,390

U.S. Pat. No. 5,037,054

U.S. Pat. No. 5,257,767

U.S. Pat. No. 5,351,897

U.S. Pat. No. 306,239

The present art of computer keyboards includes a typical keyboard having a planar keyboard bottom surface and parallel operator-proximate and operator-distal keyboard edges. The keyboard typically includes five rows of keys respectively located proximate to distal from the operator all of which are spaced at the same distance from the keyboard bottom surface 14 further includes a distal rear key row aligned in parallel with the other four key rows having keys spaced from keyboard bottom surface at a very slightly greater distance than are the keys of the other key rows. Each key has a horizontal top surface that includes an operator-proximal top edge and a parallel operator-distal top edge. The typical keyboard forms a substantially planar keyboard top area particularly defined by the operator proximal top edges of all the keys. The planar keyboard top surface is spaced at a greater distance from the keyboard bottom surface at the operator-distal keyboard top area than at the operator-proximal top area, so that the keyboard top surface and the keyboard bottom surface define therebetween an angle typically of approximately 8° that would be imaginatively formed at a pair of intersecting planes located more operator proximate than the operator proximate keyboard edge. The top individual surfaces of each key define horizontal surfaces in a single plane in each succeeding row of keys with each succeeding row of keys forming a horizontal plane stepped higher than the horizontal plane defined by the previous row of keys.

SUMMARY OF THE INVENTION

It is an object of the present invention to provide an ergonomic support for positioning a keyboard and a computer mouse and writing platform that overcomes the aforementioned problems related to computer operator comfort relating to support position and arm and wrist comfort during keying operations using conventional office furniture;

It is another object of the present invention to provide an inexpensive single ergonomic unit that includes a keyboard support and a combination computer mouse and writing platform that is removable positioned on the keyboard support and a storage drawer that is affixed to the keyboard support;

It is another object of the present invention to provide a keyboard support that interaligns with a keyboard, a computer mouse and writing platform and a wrist rest wherein the the top side of the keyboard, the top wall of the computer mouse and writing platform, and the top wall of the wrist rest are aligned in the same plane;

It is a further object of the present invention to provide a keyboard support having a wrist rest and a computer mouse platform on the keyboard support, the keyboard support including angle adjustment means that is mounted upon a carriage plate that aligns the keyboard, the wrist rest, and the computer mouse platform on the keyboard support at the same level horizontal level when the carriage plate is at a normal operating position and further aligns the same on the same level when the articulating mechanism tilts the keyboard support at positive or negative modes;

It is a further object of the present invention to provide a keyboard support with angle adjustment means connected to the carriage plate of articulating means that aligns the keyboard at a horizontal alignment in the normal operating mode and that further provides a computer mouse and writing platform having an angled bottom wall that aligns the computer mouse writing platform at the same plane as the keyboard;

It is a further object of the present invention to provide a keyboard support with angle adjustment means connected to the carriage plate of articulating means that aligns the keyboard at a horizontal plane in the normal operating mode and that further provides a wrist rest having a top wall aligned in the same horizontal plane as the keyboard and also includes a computer mouse and writing platform having an bottom wall placed upon the keyboard support top wall that aligns the computer mouse and writing platform in the same plane as the top side of the keyboard;

It is further object of the present invention to provide a keyboard support and computer mouse platform positioned on the keyboard support and further including a wrist bar that is aligned with the keyboard;

It is a further object of the present invention to provide a keyboard support with a wrist support that ergonomically aligns the wrist support with the keyboard and that further provides space for a computer mouse platform that is ergonomically aligned with the keyboard and the wrist support, and provides depth sufficient for a person to rest one's hand and forearm; and It is a further object of the present invention to provide a keyboard support with a wrist support that ergonomically aligns the wrist support with the keyboard. and that provides space for a computer mouse platform that is ergonomically aligned with the keyboard and the wrist support and further includes mechanism for tilting, swiveling, and vertical adjusting.

The present invention contemplates an ergonomic keyboard support device for a computer keyboard having a substantially planar key upper plane, comprising a keyboard support having an operator-proximal keyboard support edge and a substantially planar keyboard support top surface; a support bar for maintaining wrist and forearm support during keyboard operations; and a computer mouse platform for holding a computer mouse and for writing by a keyboard operator and for maintaining wrist support during mouse operations. The support bar, which is connected to the top surface of the keyboard support across the operator-proximal keyboard support edge, has a substantially planar bar top surface. The mouse platform is movably positioned upon the planar top surface of the keyboard support and has a substantially planar top surface that is substantially in the same plane as the planar bar top surface. A wedge under the support platform upon a carriage plate connected to articulated linkage tilts the keyboard support at approximately 8° relative to the horizontal so that in turn the keyboard frame is tilted to an angle wherein the upper plane defined by the keyboard keys is horizontal along with the top planes of the support bar and the mouse platform. The articulated linkage can tilt the device to a plurality of angles and positions.

The present invention can be better understood and the objects and important features, other than those specifically set forth above, will become apparent when consideration is given to the following details and description, which when taken in conjunction with the annexed drawings, describes, discloses, illustrates, and shows preferred embodiments or modification of the present invention and what is presently considered and believed to be the best mode of practice in the principles thereof.

A BRIEF STATEMENT OF THE FIGURES

FIG. 1 is a perspective view of the present invention that illustrates a keyboard support with a keyboard positioned thereon shown in phantom line and a computer mouse platform positioned on the keyboard support and a computer mouse placed upon the computer mouse platform and further showing a monitor support with a monitor and a computer unit placed thereon in operational relationship to the keyboard.

Figure 8:
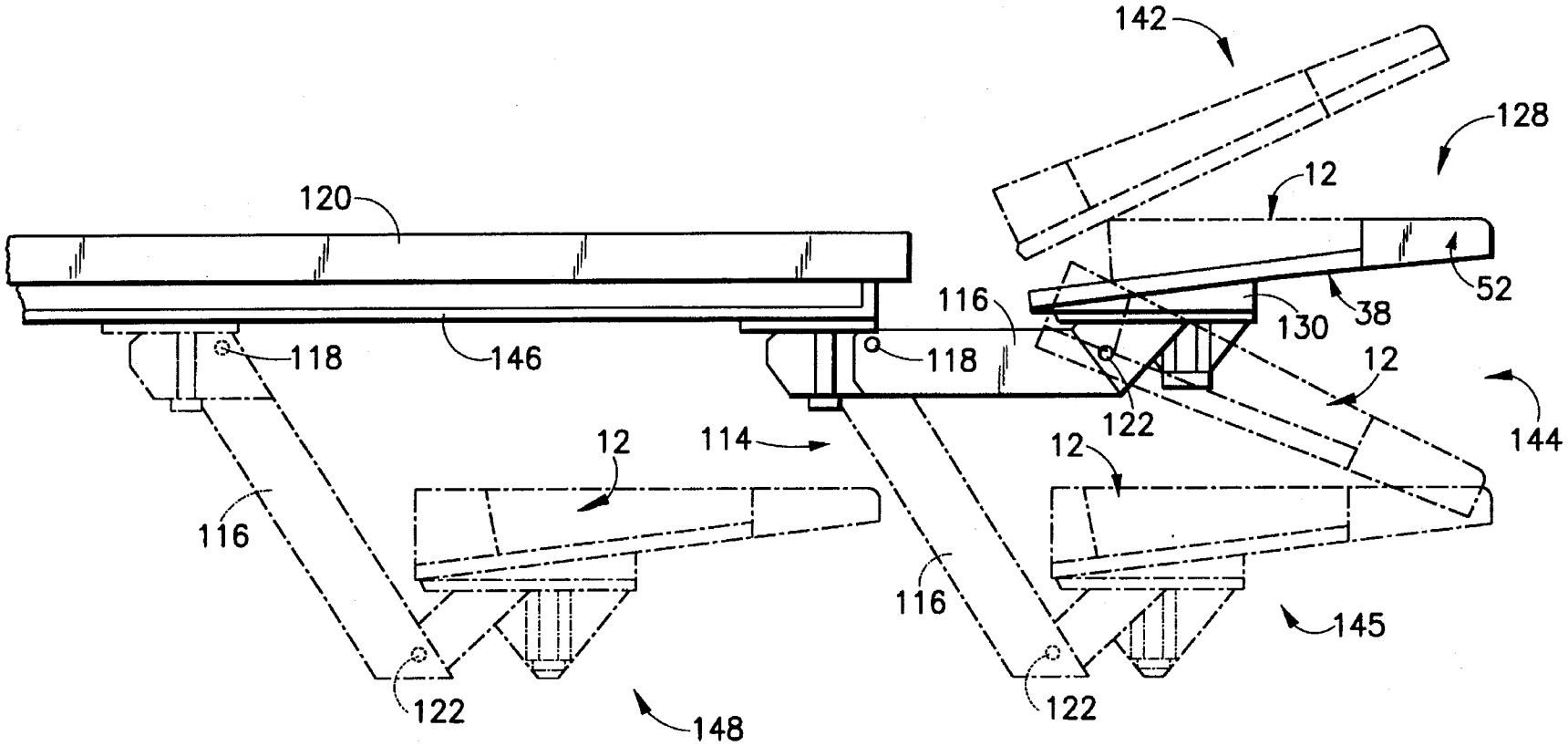
Figure 9:
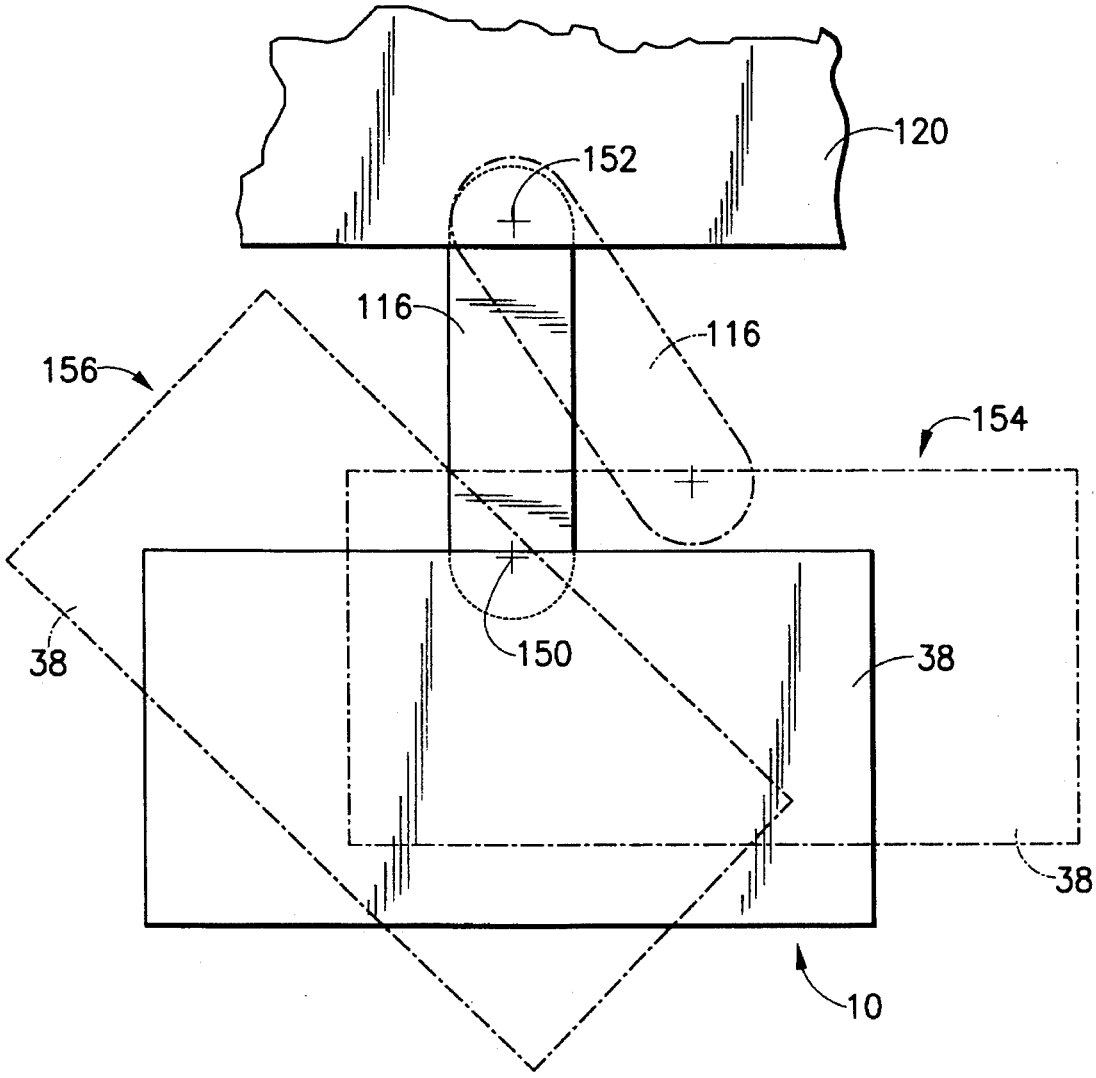

FIG. 8 is a schematic side view of the keyboard support and the monitor support including an articulating mechanism that shows the keyboard support in a normal horizontal operating mode; and further indicates the keyboard support in phantom line at positive and negative tilted modes of +15° and −23°; and in phantom line at a lowered mode; and in phantom line at a lowered forward storage mode; and FIG. 9 is a schematic top view of the keyboard support and the monitor support including a schematic articulating mechanism that shows the keyboard support in a normal operating mode parallel with and directly facing the monitor support; in phantom line positioned parallel with and angled relative to the monitor support; and in phantom line positioned generally parallel with and slid to one side relative to the monitor support.

DETAILED DESCRIPTION OF THE PREFERRED EMBODIMENTS

Reference is now made in detail to the drawings wherein the same numerals refer to the same or similar elements throughout.

Figure 1:
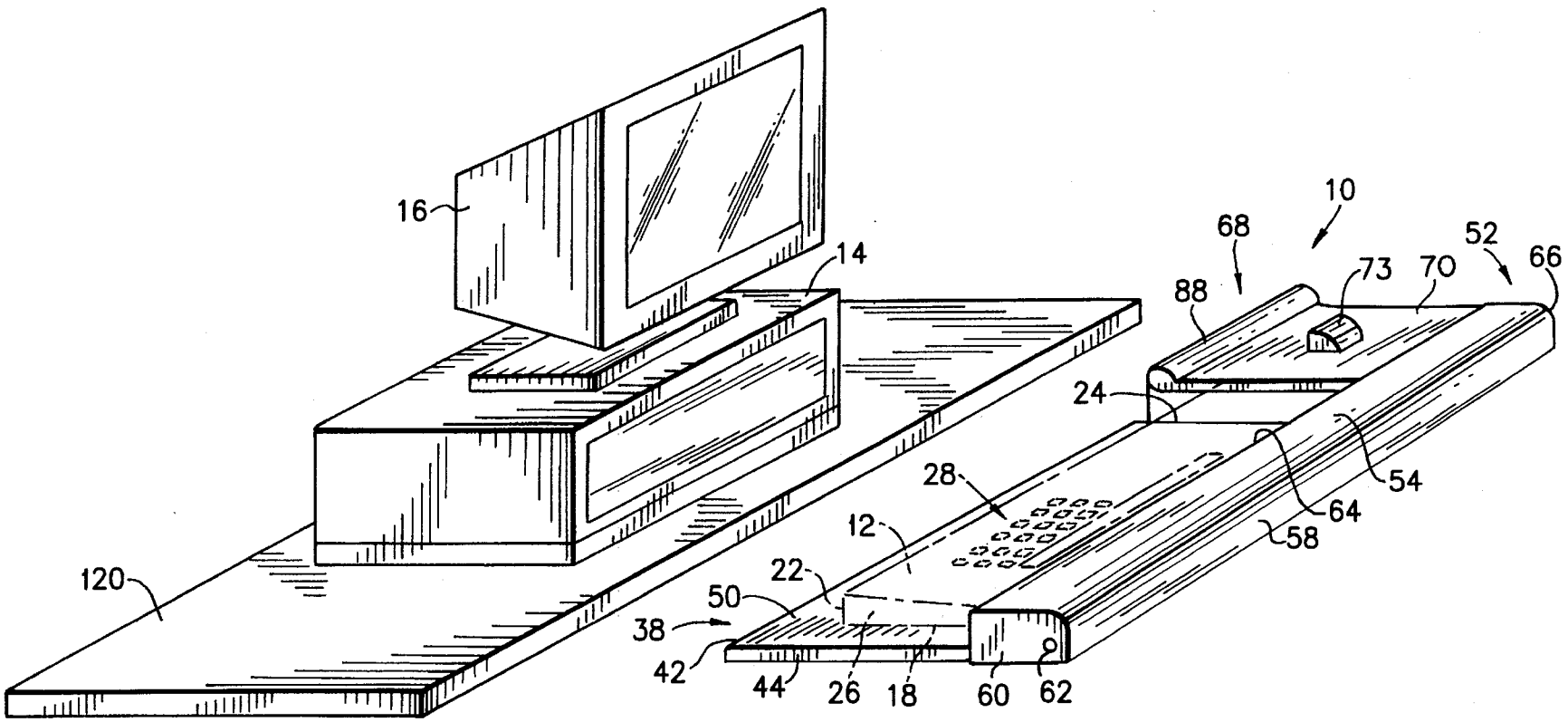

An ergonomic keyboard support device 10 in accordance with the present invention is illustrated in FIG. 1 in conjunction with a typical computer keyboard 12, a personal computer 14, and a monitor 16 and is shown in isolation in FIGS. 2–7.

Computer keyboard 12, which is shown in phantom line, includes a planar keyboard frame bottom surface 18 and parallel operator-proximate and operator-distal keyboard frame edges 20 and 22, respectively, and parallel side edges 24 and 26.

Computer keyboard 12 typically includes five rows of keys 28 including the spacebar in key rows 30A (including the spacebar), 30B, 30C and 30D, located proximate to distal from the operator, respectively, all of which are spaced at the same distance from keyboard frame bottom surface 18, and a distal rear key row 30E aligned in parallel with key rows 30A–30D having keys 28 spaced from keyboard frame bottom surface 18 at a very slightly greater distance than are keys 28 of key rows 30A–30D.

Figure 5:
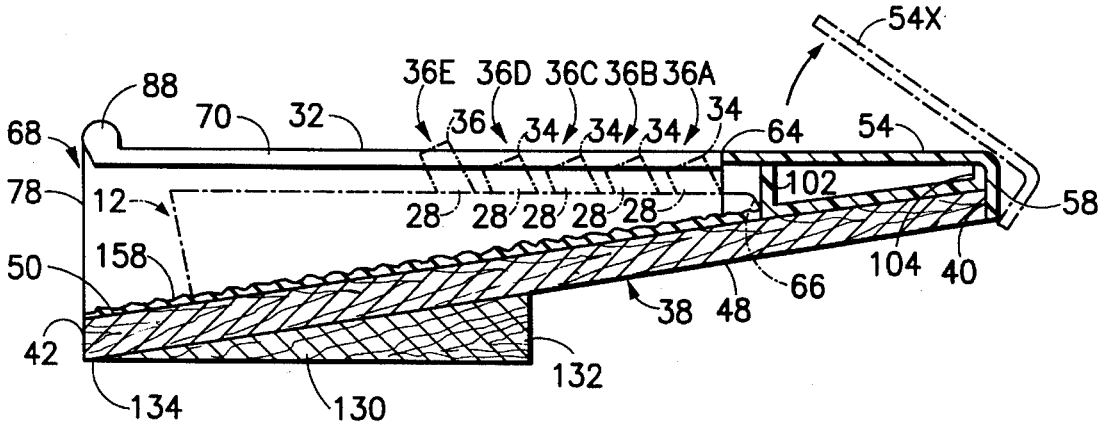
FIG. 5 is a sectional view taken through line 4—4 of FIG. 2 wherein the cowel upper planar top surface is substantially the same as the key upper plane of the computer keyboard.

As seen in FIG. 5, a key upper plane 32 of computer keyboard 12 is defined by the upper edges 34 of keys 28 of key rows 30A–30D. Key upper plane 32 is spaced from keyboard frame planar bottom surface 18 at distal keyboard frame edge 22 at a first distance that is greater than the second distance from key upper plane 32 to keyboard frame planar bottom surface 18 at proximal keyboard frame edge 20. Keyboard frame planar bottom surface 18 and key upper plane 32 define therebetween an angle typically of approximately 8° that would be imaginatively formed at a pair of intersecting planes located more operator proximal than operator proximal keyboard frame edge 20. The angle of 8° is the most common alignment angle of keyboards so as to create an advantageous key work surface for the keyboard operator.

Ergonomic keyboard support device 10 includes a keyboard support 38 made of wood or other suitable material having an operator-proximal keyboard support edge 40 and a parallel operator-distal support edge 42 joined to parallel keyboard support operator-left and operator-right side edges 44 and 46, respectively, and further having a planar keyboard support bottom surface 48 and a planar keyboard support top surface 50 that is parallel to planar keyboard bottom surface 48. Keyboard frame bottom surface 18 rests upon keyboard support top surface 50.

Ergonomic keyboard support device 10 further includes a rest bar, or pause bar, or cowel, 52 made of plastic or other suitable material for maintaining wrist and/or forearm support during and between keyboard operations. Cowel 52 includes a cowel top wall 54 having a cowel planar top surface 56, a cowel upright front wall 58 that overhangs and covers operator-proximal keyboard support edge 40, and opposed upright cowel side walls 60 that overhang and cover keyboard support side edges 44 and 46. Cowel planar top surface 56 is in the same plane as key upper plane 32.

Figure 5A:
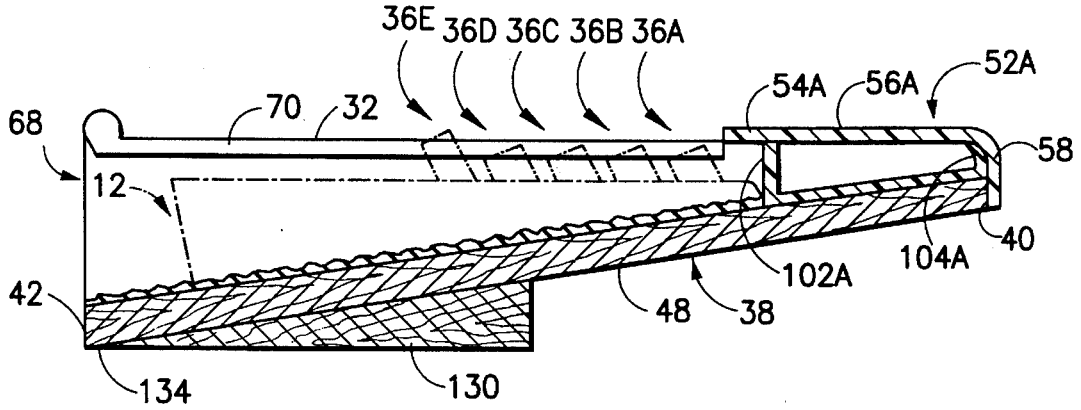
FIG. 5A is a sectional view analogous to the sectional view of FIG. 5 with the cowel planar top surface being slightly higher than the key upper plane of the computer keyboard.

As illustrated in FIG. 5A, cowel top wall 54A is slightly higher than cowel planar top surface 56, that is, cowel planar top surface 56A is in a plane parallel to and slightly spaced above key upper plane 32.

Cowel 52 is rotatably connected to keyboard support 38 across operator-proximal keyboard support edge 40 by opposed pivot pins 62 that extend into keyboard support side edges 44 and 46 near operator-proximal keyboard support edge 40.

Cowel top wall 54 includes a cowel forward top edge 64 that extends laterally to and spaced from operator-proximal keyboard support edge 40 between keyboard support side edges 44 and 46 and further extends over and beyond operator-proximal keyboard frame edge 20 of computer keyboard 12 when keyboard frame edge 20 can be slid under cowel top wall 54 so that a space is defined between cowel top wall 54 and keyboard 12. The position illustrated throughout of operator-proximal keyboard frame edge 20 being slid under cowel top wall 54 is an optional position selected by the keyboard operator. Likewise, computer keyboard 12 can be optionally positioned operator-left from the position shown in the figures.

Cowel planar top surface 56 in particular is used by the keyboard operator to rest the wrist and/or forearm during pauses in keyboard operations. A curved surface 66 is defined between cowel top wall 54 and cowel front wall 58.

Figure 2:
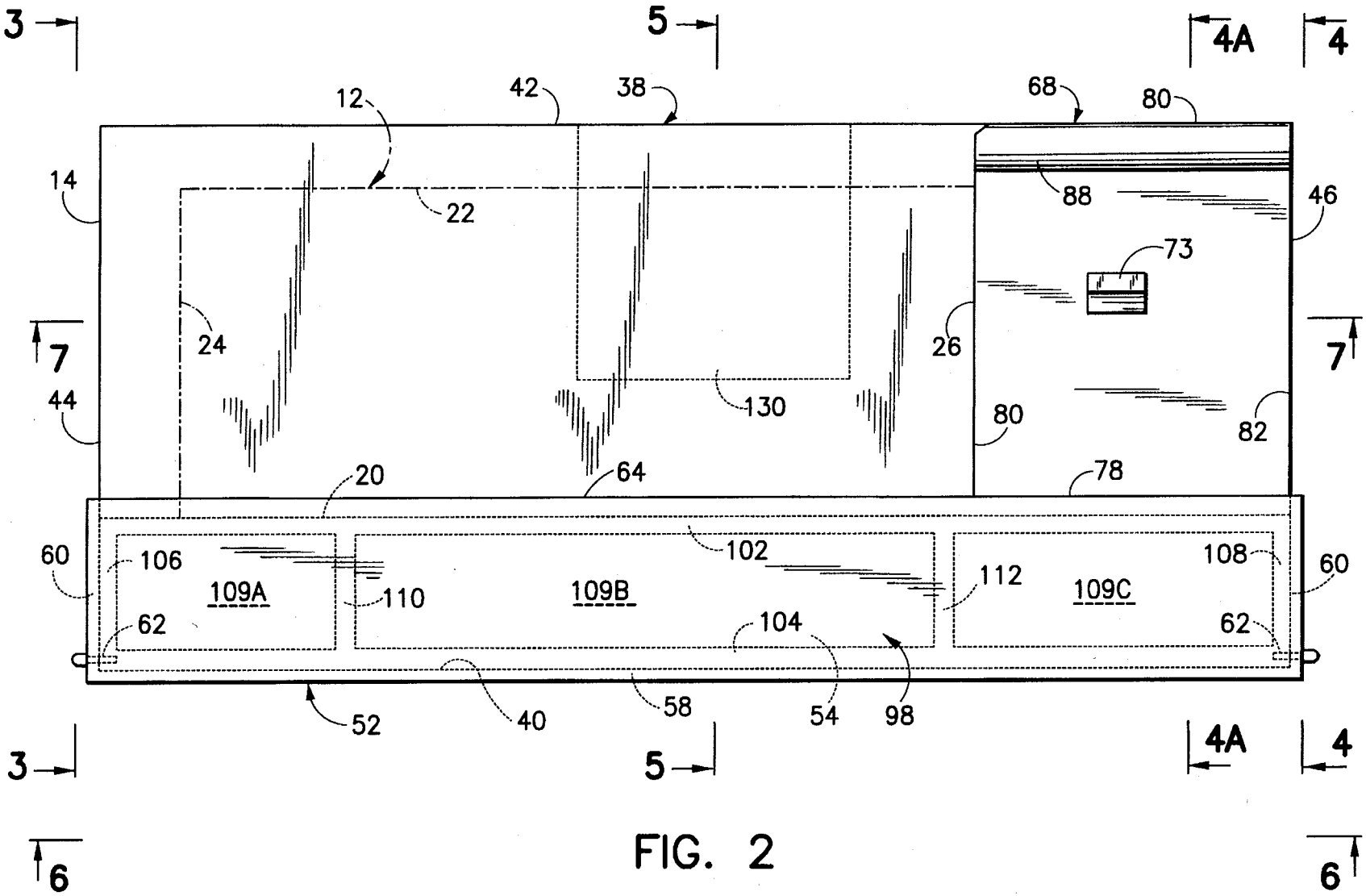
FIG. 2 is a top view of the invention taken through plane 2—2 in FIG. 1.
Figure 3:
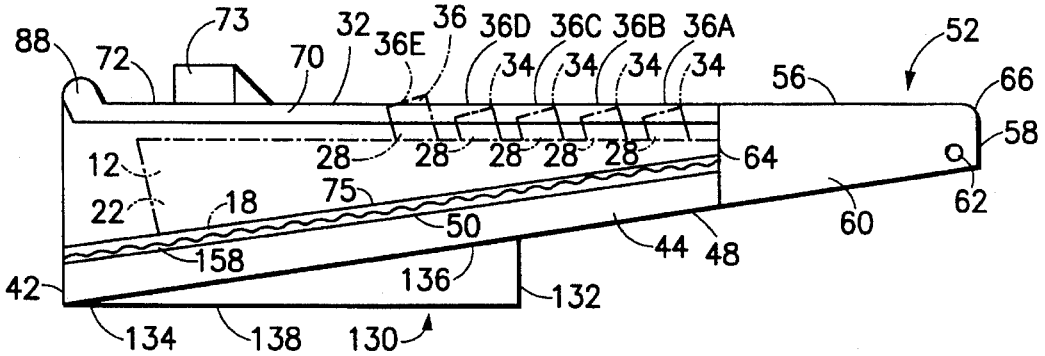
FIG. 3 is a an elevational side view taken through line 3—3 of FIG. 2.
Figure 4:
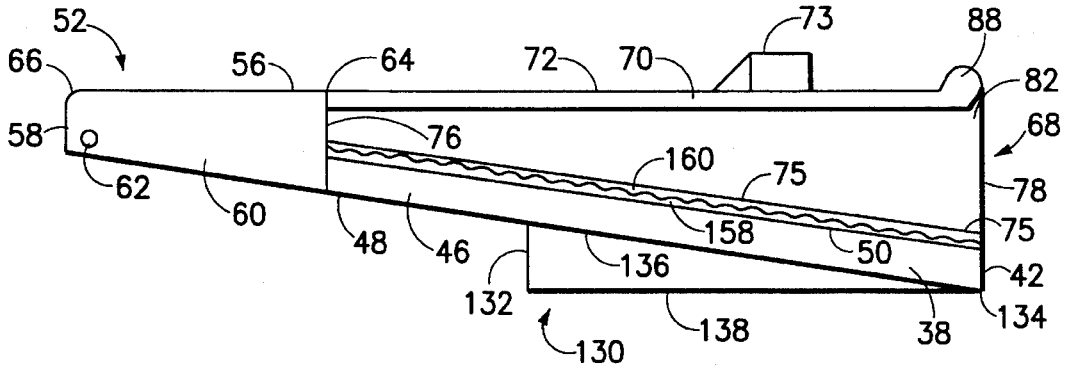
FIG. 4 is an elevational side view taken through line 4—4 of FIG. 2.
Figure 7:
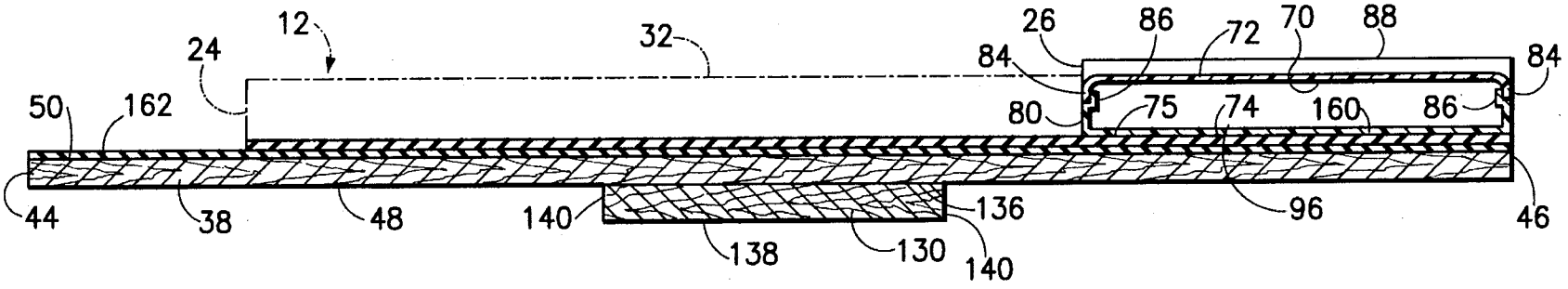
FIG. 7 is a sectional view of taken through line 7—7 of FIG. 2.
Figure 6:
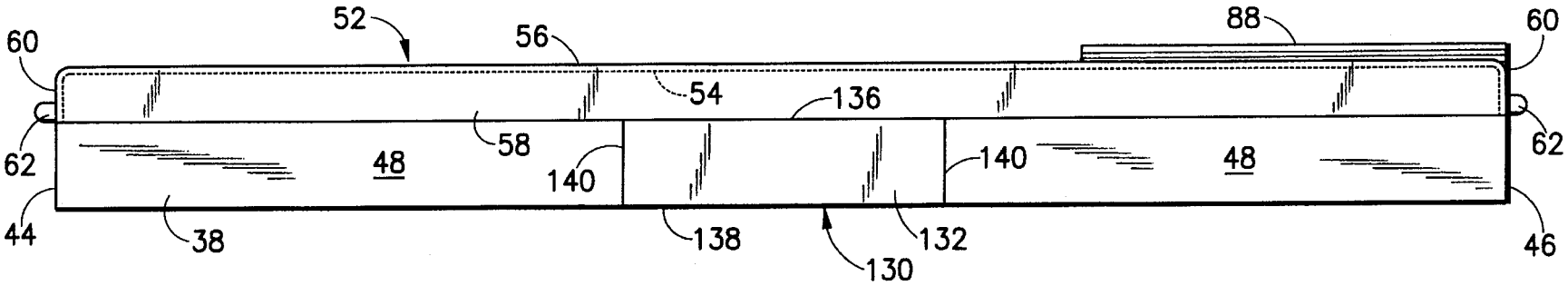
FIG. 6 is an elevational front view through line 5—5 of FIG. 2 including the FILL IN shown in sectional view.

As best seen in FIGS. 2, 4, and 7, a platform 68 made of plastic or other suitable material removably positioned upon keyboard support top surface 50 has a platform top wall cover 70 having a planar top surface 72 aligned in the same plane as cowel planar top surface 56 and substantially in the same plane as key upper plane 32. A computer mouse 73 is shown positioned in a random position on platform planar top surface. Platform 68 includes a platform bottom wall 74 having a platform planar bottom surface 75 in removable contact with keyboard support planar top surface 50. Platform 68 includes platform parallel upright operator-proximal and operator-distal walls 76 and 78, respectively, with platform operator-proximal wall 76 being in contact with cowel forward top edge 64 and platform operator-distal wall 78 being in alignment with operator-distal keyboard support edge 42.

Platform 68 also includes platform parallel upright inner and outer side walls 80 and 82, respectively, with inner side wall 80 being parallel to and distanced from keyboard support side edge 44 and with outer side wall 80 being aligned with keyboard support side edge 44. In FIGS. 1, 2, and 7, keyboard 12 is shown in an optional location adjacent to platform inner side wall 82, but keyboard 12 may be located in any open position on keyboard support top surface 50.

Cover 70 is removably mounted upon platform operator-proximal and operator-distal walls 76 and 78 and platform inner and outer side walls 80 and 82. As seen in FIG. 7, a pair of short downwardly extending flanges 84 connected to the inner and outer sides of cover 70 are positioned upon a pair of L-shaped supports 86 extending inwardly from inner and outer side walls 80 and 82 so that cover 70 is firmly and removably seated upon inner and outer side walls 80 and 82. Cover proximal and distal edges 92 and 94, respectively, rest upon the tops of platform operator-proximal and operator-distal walls 78 and 80. A curved stop member 86 unitary with cover 70 extends across platform top surface 72 at above platform operator distal wall 80.

Figure 4A:
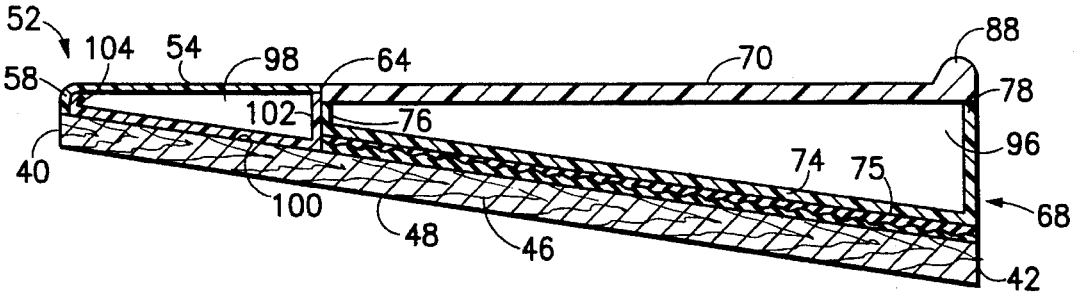
FIG. 4A is a sectional view taken through line 4A—4A of FIG. 2.

Platform 68 defines a storage space, 96, seen best in FIG. 4A, made of plastic or other suitable material which in particular is defined by cover 70, platform operator-proximal and -distal walls 76 and 78, platform inner and outer side walls 82 and 84, and platform bottom wall 74.

Ergonomic keyboard support device 10 also includes a storage tray, or compartment, 98 positioned under cowel 52 upon said keyboard support top surface extending across said operator-proximal keyboard support edge. Compartment 98 has an top aperture and is overall defined by a bottom wall 100 that is suitably secured to keyboard support support stop surface 50 between keyboard support side edges 44 and 46 and along operator-proximate keyboard support edge 40; an upright wall 102 extending between keyboard support side edges 44 and 46 and aligned laterally along operator-proximate keyboard support edge 40; a wall 104 lateral to and spaced inwardly from wall 102; and a pair of upright opposed end walls 106 and 108 that are joined to walls 102 and 104. Compartment 98 is separated into three sub-compartments 109A, 109B, and 109C by a pair of upright cross-walls 110 and 112 that are connected to compartment bottom wall 100 and compartment walls 102 and 104.

When cowel top wall 54 is rotated from the closed position illustrated in FIG. 5 to an open position 54X as indicated in phantom line, the top side of compartment 98 is opened and compartment 98 is accessible to the operator.

FIG. 5A is analogous to FIG. 5 with, however, a larger compartment 98A than compartment 98 with a cowel 52A having a cowel top wall 54A spaced slightly above key upper plane 32 and inner and outer walls 102A and 102A being slightly more distant from platform support bottom surface 48 than inner and outer transverse walls 102 and 104 of FIG. 5. Compartment 98 also has end walls that are likewise higher than end walls 106 and 108. The result is that compartment 98A is slightly larger than compartment 98. For the purposes of the present invention and this application, cowel planar top surface 56A and key upper plane 32 are substantially in the same plane in FIG. 5A is equivalent to the relationship shown in FIG. 5A between cowel planar top surface 56 and key upper plane 32 in FIG. 5. In accordance with the present invention, cowel planar top surface 56, shown in FIG. 5, for example, can in fact be slightly higher than key upper plane 32 and still be substantially in the same plane with key upper plane 32, that is, cowel planar top surface 56A of FIG. 5 is still substantially in the same plane as key upper plane 32.

Ergonomic keyboard support device 10 in accordance with the present invention includes key upper plane 32, cowel planar top surface 56, and platform planar top surface 72 all being in the same plane or in substantially in the same plane. FIGS. 1–7 illustrate key upper plane 32, cowel planar top surface 56, and platform planar top surface 72 being in a single horizontal plane, or being substantially in a single horizontal plane.

FIG. 8 illustrates ergonomic keyboard support device 10 operatively mounted with an articulated linkage 114 of a type known in the art that includes a linear linkage arm 116 that is secured at one end to a pivot mount 118 to the underside of a monitor platform 120. The other end of linkage arm 116 is secured to a pivot mount 122 that is secured to a support structure, or carriage plate, 124, which has a carriage plate planar top surface 126. Ergonomic keyboard support device 10 is illustrated in a first operator selected position 128 shown in solid line, with computer keyboard 12 shown in phantom line, first position 128 being in the horizontal mode.

FIGS. 2–7 illustrate ergonomic keyboard support device 10 with an aligning wedge 130 made of wood or other suitable material for aligning keyboard support 38 so that key upper plane 32, cowel planar top surface 56, platform planar top surface, and in addition, planar top surface 126 of carriage plate 124 are all in horizontal alignments. Wedge 130 has a triangular configuration as seen in side view with a thick edge 132 tapering to a thin edge 13 and having upwardly facing and downwardly facing second planar surfaces 136 and 138, respectively. Thick edge 132 is has an operator-proximal orientation and thin edge 134 has an operator-distal position. Upwardly facing planar surface 136 is secured in a suitable manner with planar keyboard support bottom surface 48, that is, keyboard support 38 is situated upon wedge 130. Wedge 130 in turn is situated upon carriage plate 124, in particular, downwardly facing planar surface 138 lies upon and is secured in a suitable manner to the upwardly facing planar surface of carriage plate 124. Wedge 130 has opposed parallel triangular-shaped vertical walls 140. Wedge 130 is positioned at the mid-area of keyboard support 38 between keyboard support side edges 44 and 46 with thin edge 134 proximate and lateral to operator distal keyboard support edge 42.

The angle formed by the upwardly and downwardly facing planar surfaces 136 and 138 of wedge 130 define an angle that is equal to, but opposed to, the angle previously described relating to keyboard frame planar bottom surface 18 and key upper plane 32, which define therebetween an angle typically of approximately 8° that would be imaginatively formed at a pair of intersecting planes located more operator proximal than operator proximal keyboard frame edge 20.

The opposed angle defined by wedge 130 overcomes the angle at which a normally designed key upper plane would have when a keyboard frame bottom surface was placed upon a horizontal surface. The mentioned 8° work angle at which most key upper planes are aligned can vary among manufacturers, but this variance can be accommodated by slight variations in the design of the present invention and such variations, therefore, do not affect the inventive aspects of the present invention.

Key upper plane 32 of computer keyboard 12 is spaced at a greater distance from the planar keyboard frame bottom surface 18 at operator-distal keyboard edge 22 than at operator-proximal keyboard edge 20, wherein key upper plane 32 and planar keyboard frame bottom surface 18 define therebetween a first angle. Planar top surface 126 of carriage plate 124 is aligned in a substantially horizontal plane. Planar keyboard support bottom surface 48 is substantially planar to planar keyboard top surface 50. Wedge 130 aligns keyboard support 38 wherein planar keyboard support top surface 50 is in plane defining a second angle relative to a horizontal plane wherein the first and second angles are equal, so that the substantially planar key upper plane 32 computer keyboard 12 lies in a substantially horizontal plane. Platform 68 means includes a substantially Planar platform bottom surface 75 define a third angle relative to a horizontal plane, the third angle being equal to the first and second angles. Planar platform bottom surface 75 extends downwardly from said platform operator proximal wall 76 to platform operator-distal wall 78 relative to the horizontal at third angle.

FIG. 8 illustrates orientations of ergonomic keyboard support device 10 when articulated linkage 114 is adjusted at pivot mount 122, which allows angular adjustment so that planar top surface 126 of carriage plate 124 can be rotated typically between a number of positive +15° and a negative— 23° tilted operational planes relative to the horizontal plane. A second operator selected position 142 wherein ergonomic keyboard support device in phantom line is positioned at a positive 15° angle is shown in FIG. 8. A third operator selected position 144 wherein ergonomic keyboard support device in phantom line is positioned at a negative 23° angle is also shown in FIG. 8.

Articulated linkage 114 can also be adjusted at pivot mount 124, which allows a vertical adjustment so that ergonomic keyboard support device 10 can be lowered from the basic first operator selected position 128 to a fourth operator selected position 145 wherein ergonomic keyboard support device 10 shown in phantom line in FIG. 8, wherein planar top surface 126 of carriage plate 124 although moved to a new lower plane remains in a horizontal orientation as in first operator selected position 128.

Articulate linkage 114 is also adjustable so that ergonomic keyboard support device 10 can be horizontally moved from the fourth operator selected position 145 along rail support 146 to a fifth operator selected position 148 shown in phantom line, which is a storage position directly under monitor platform 120 in which position planar top surface of carriage plate 124 remains in a horizontal orientation as in third operator selected position 144.

FIG. 9 illustrated ergonomic keyboard support device 10 in swivel positions that are associated with articulated linkage 114 wherein ergonomic keyboard support device 10 is shown in solid line in a first operating mode directly facing monitor table 120. Linkage arm 116 is mounted to the underside of keyboard support 38 at swivel connection 150 and is also mounted to the underside of monitor platform 120 at swivel connection 152. Keyboard support 38 is shown in phantom line having been swiveled at swivel connection 152 to a first swivel position 154 wherein keyboard support 38 is moved laterally to monitor table 120. Also, keyboard support 38 is shown in phantom line having been swiveled at swivel connection 150 to a second swivel position 156 wherein keyboard support 38 is rotated to a selected angle relative to monitor table 120.

A non-skid material such as ribbed rubber 158 is applied with adhesive keyboard support top surface 50. Non-skid material such as ribbed rubber 160 is applied with adhesive to platform planar bottom surface 76. Also, a non-skid material such as ribbed rubber 158 is applied with adhesive to keyboard frame bottom surface 18. Such non-skid materials 158, 160, and 162 prevent movement of keyboard 12 and platform 68 relative to keyboard support top surface 50.

Platform 68 is illustrated operator-right and keyboard 12 is illustrated operator-left in the figures, which is the position that is used by right-handed operators. Left handed operators, however, would move platform 68 to an operator-left in the figures and keyboard 12 would be moved to an operator-right position in a mirror image of the position shown in the figures.

Although the present invention has been described in some detail by way of illustration and example for purposes of clarity and understanding, it will, of course, be understood that various changes and modifications may be made in the form, details, and arrangements of the parts without departing from the scope of the invention set forth in the following claims. For example, computer keyboards can vary in design details. The present invention can apply to these design variations with the necessary changes being made within the spirit of the present invention.

What is claimed is:

1. An ergonomic keyboard support device for a computer keyboard having a substantially planar key upper plane, comprising, a keyboard support having an operator-proximal keyboard support edge and a substantially planar keyboard support top surface, bar means for maintaining wrist and forearm support during keyboard operations, said bar means being connected to said keyboard support top surface across said operator-proximal keyboard support edge and having a substantially planar bar top surface, and platform means for holding a computer mouse and for writing by a keyboard operator and for maintaining wrist support during mouse operations, said platform means being movably positioned upon said planar keyboard support top surface, said platform means having a substantially planar platform top surface substantially in the same plane as said planar bar top surface.

2. The device according to claim 1, wherein the substantially planar key upper plane of the computer keyboard is substantially parallel to said substantially planar bar top surface and to said substantially planar platform top surface.

3. The device according to claim 2, wherein said planar key upper plane is substantially in the same plane as said planar bar top surface and to said planar platform top surface.

4. The device according to claim 1, wherein said keyboard support further has an operator-distal keyboard support edge parallel to said keyboard support operator-proximal edge and said platform means includes parallel platform upright operator-proximal and operator distal walls in alignment with said bar means and with said operator-distal keyboard support edge, respectively.

5. The device according to claim 4, further including compartment means for holding office supplies positioned under said bar means and secured to said planar keyboard support top surface and extending laterally along said operator-proximal keyboard support edge.

6. The device according to claim 5, wherein said compartment defines a top aperture, and further including a cover wall over said top aperture, said cover wall being integral with said bar means, said bar means being pivotably attached to said keyboard support for rotational movement of said cover wall between open and closed positions relative to said top aperture.

7. The device according to claim 1, wherein said platform means further includes a pair of substantially parallel upright side walls joined to said platform operator-proximal and said operator-distal walls, a substantially planar platform bottom wall removably positioned upon said planar keyboard support top surface, and a platform top wall cover including said planar platform top surface, said platform top wall cover, said platform bottom wall, said platform operator-proximal and said platform operator-distal walls, and said platform side walls defining a space, said platform top wall cover being removably positioned upon said platform side walls and said platform front and side walls and covering said space.

8. The device according to claim 4, wherein said computer keyboard further includes a substantially planar keyboard bottom surface and parallel operator-proximate and operator-distal keyboard edges, the key upper plane of the computer keyboard being spaced at a greater distance from the planar keyboard bottom surface at the operator-distal keyboard edge than at the operator-proximal keyboard edge, wherein the key upper plane and the planar keyboard bottom surface define therebetween a first angle; and further including a support structure having a substantially planar support structure top surface aligned in a substantially horizontal plane; said keyboard support having a substantially planar keyboard support bottom surface substantially planar to said planar keyboard support top surface; and further including means for aligning said keyboard support wherein said planar keyboard support top surface is in plane defining a second angle relative to a horizontal plane, said first and second angles being equal, wherein said substantially planar key upper plane of said computer keyboard is a substantially horizontal plane, said means for aligning being connected to said planar keyboard support bottom surface and being positioned on said planar support structure top surface, whereby said planar platform top surface, said planar bar means top surface and said key upper plane of said computer keyboard are aligned substantially horizontal.

9. The device according to claim 8, wherein said platform means includes a substantially planar platform bottom surface defining a third angle relative to a horizontal plane, said third angle being equal to said first and second angles, said planar platform bottom surface extending downwardly from said platform operator-proximal wall to said platform operator-distal wall relative to the horizontal at said third angle.

10. The device according to claim 8, wherein said means for aligning is a wedge connected to said keyboard support bottom surface, said wedge including a thick edge and a thin edge and upward facing and downward facing taper faces, said upward tapering face being connected to said planar keyboard support bottom surface, said thin edge being positioned relative to said to said operator-distal keyboard support edge and said thick edge being positioned relative to said operator-proximal support edge, said wedge being positioned on said planar support structure top surface.

11. The device according to claim 8, further including monitor support means for holding a computer monitor in operational relationship with the computer keyboard, and further including articulated linkage means for adjustment of said keyboard support between a plurality of positive and negative tilted operational planes relative to the horizontal plane, said articulated linkage means being connected to said monitor support means and to said keyboard support.

12. The device according to claim 8, wherein said articulated linkage means further includes means for swiveling said keyboard support between a plurality of angled positions relative to said monitor support.

13. The device according to claim 8, wherein said articulated linkage means further includes means for vertically adjusting said keyboard support between a plurality of fully raised and fully lowered positions.

14. The device according to claim 13, wherein said articulated linkage means further includes means for horizontally adjusting said keyboard support between said fully lowered position and a position located underneath said monitor support means.

15. The device according to claim 2, further including non-skid means for preventing movement of said keyboard and said platform means relative to said keyboard support top surface.

* * * * *